US005920906A

United States Patent [19]

Good

[11] Patent Number: 5,920,906

[45] Date of Patent: Jul. 13, 1999

[54] COAT WITH ATTACHED COMBINED OPTIONAL HOOD, COLLAR, AND/OR SCARF

[76] Inventor: Barbara Good, 2200 Ben Franklin Pwky., #E1903, Philadelphia, Pa. 19130

[21] Appl. No.: 09/003,649

[22] Filed: Jan. 7, 1998

[51] Int. Cl.[6] ..... A41B 1/00

[52] U.S. Cl. ..... 2/93; 2/85; 2/108

[58] Field of Search ..... 2/93, 84, 98, 85, 2/88, 90, 94–96, 108, 69, 74, 105, 106, 80, 75, 116, 129, 130, 133, 202–204, 207, 208

[56] References Cited

U.S. PATENT DOCUMENTS

| | | | |
|---|---|---|---|
| 2,439,382 | 4/1948 | De Grazia | 2/84 |
| 2,515,657 | 7/1950 | Mendl | 2/84 |
| 2,834,966 | 5/1958 | Zimmerman | 2/84 |
| 3,147,490 | 9/1964 | Allen et al. | 2/84 |

*Primary Examiner*—G Hale

[57] ABSTRACT

A coat is provided having a neck aperture. A pair of buttons is mounted on a top of the coat on diametrically opposed sides of the neck aperture. An auxiliary garment is stitchedly coupled to a rear peripheral edge of the neck aperture and defines a pair of lateral ends having slits formed therein for releasably coupling with the buttons.

9 Claims, 3 Drawing Sheets

COAT WITH ATTACHED COMBINED OPTIONAL HOOD, COLLAR, AND/OR SCARF

BACKGROUND OF THE INVENTION

1. Field of the Invention

The present invention relates to a coat with attached combined optional hood, collar, and/or scarf and more particularly pertains to allowing a user to wear a coat with varying styles.

2. Description of the Prior Art

The use of scarves is known in the prior art. More specifically, scarves heretofore devised and utilized for the purpose of providing warmth are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,115,516; U.S. Pat. No. 4,554,682; U.S. Pat. No. 309,671; U.S. Pat. No. 4,110,846; U.S. Pat. No. 4,771,479; and U.S. Pat. No. 4,5,115,517.

In this respect, the coat with attached combined optional hood, collar, and/or scarf according to the present invention substantially departs from the conventional concepts and designs of the prior art, and in so doing provides an apparatus primarily developed for the purpose of allowing a user to wear a coat with varying styles.

Therefore, it can be appreciated that there exists a continuing need for a new and improved coat with attached combined optional hood, collar, and/or scarf which can be used for allowing a user to wear a coat with varying styles. In this regard, the present invention substantially fulfills this need.

SUMMARY OF THE INVENTION

In view of the foregoing disadvantages inherent in the known types of scarves now present in the prior art, the present invention provides an improved coat with attached combined optional hood, collar, and/or scarf. As such, the general purpose of the present invention, which will be described subsequently in greater detail, is to provide a new and improved coat with attached combined optional hood, collar, and/or scarf which has all the advantages of the prior art and none of the disadvantages.

To attain this, the present invention essentially comprises a coat having a generally tubular central extent with a pair of arm holes to which upper ends of a pair of long sleeves are appended. Lower ends of the sleeves each have an annular elastic band mounted in an interior surface thereof. Note FIG. 6. The central extent further has a circular neck aperture formed on a top thereof. A vertical linear slit is formed down a front of the coat thus defining a pair of free edges. Such free edges include a first free edge with a plurality of linearly aligned primary slits formed therein. Associated therewith is a second free edge with a plurality of primary buttons mounted therein for releasably coupling with the primary slits. A pair of pockets are formed on the front of the central extent on opposite sides thereof. Each pocket defines an open top sealable with a zipper. Also included is a pair of secondary buttons mounted on a top of the central extent. The secondary buttons are each positioned on diametrically opposed sides of the neck aperture on shoulders of the coat. Finally, an auxiliary garment includes a pair of cloth pieces each defined by a periphery having a front linear edge and a rear arcuate edge. As shown in FIG. 5, the cloth pieces are each stitched together along the entire rear arcuate edges to define an interior space and an open front. A bottom one of the cloth pieces is stitchedly coupled at a center of the linear edge thereof to a rear peripheral edge of the neck aperture. The cloth pieces of the garment further define a pair of lateral ends having a secondary slit formed therein. A coat having a generally tubular central extent with a pair of arm holes to which upper ends of a pair of long sleeves are appended. Lower ends of the sleeves each have an annular elastic band mounted in an interior surface thereof. Note FIG. 6. The central extent further has a circular neck aperture formed on a top thereof. A vertical linear slit is formed down a front of the coat thus defining a pair of free edges. Such free edges include a first free edge with a plurality of linearly aligned primary slits formed therein. Associated therewith is a second free edge with a plurality of primary buttons mounted therein for releasably coupling with the primary slits. A pair of pockets are formed on the front of the central extent on opposite sides thereof. Each pocket defines an open top sealable with a zipper. Also included is a pair of secondary buttons mounted on a top of the central extent. The secondary buttons are each positioned on diametrically opposed sides of the neck aperture on shoulders of the coat. Finally, an auxiliary garment includes a pair of cloth pieces each defined by a periphery having a front linear edge and a rear arcuate edge. As shown in FIG. 5, the cloth pieces are each stitched together along the entire rear arcuate edges to define an interior space and an open front. A bottom one of the cloth pieces is stitchedly coupled at a center of the linear edge thereof to a rear peripheral edge of the neck aperture. The cloth pieces of the garment further define a pair of lateral ends having a secondary slit formed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved coat with attached combined optional hood, collar, and/or scarf which has all the advantages of the prior art scarf and none of the disadvantages.

It is another object of the present invention to provide a new and improved coat with attached combined optional hood, collar, and/or scarf which may be easily and efficiently manufactured and marketed.

It is a further object of the present invention to provide a new and improved coat with attached combined optional hood, collar, and/or scarf which is of a durable and reliable construction.

An even further object of the present invention is to provide a new and improved coat with attached combined optional hood, collar, and/or scarf which is susceptible of a low cost of manufacture with regard to both materials and labor, and which accordingly is then susceptible of low prices of sale to the consuming public, thereby making such coat with attached combined optional hood, collar, and/or scarf economically available to the buying public.

Still yet another object of the present invention is to provide a new and improved coat with attached combined optional hood, collar, and/or scarf which provides in the apparatuses and methods of the prior art some of the advantages thereof, while simultaneously overcoming some of the disadvantages normally associated therewith.

Still another object of the present invention is to allow a user to wear a coat with varying styles.

Lastly, it is an object of the present invention to provide a new and improved coat having neck aperture. A pair of buttons is mounted on a top of the coat on diametrically opposed sides of the neck aperture. An auxiliary garment is stitchedly coupled to a rear peripheral edge of the neck aperture and defines a pair of lateral ends having slits formed therein for releasably coupling with the buttons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
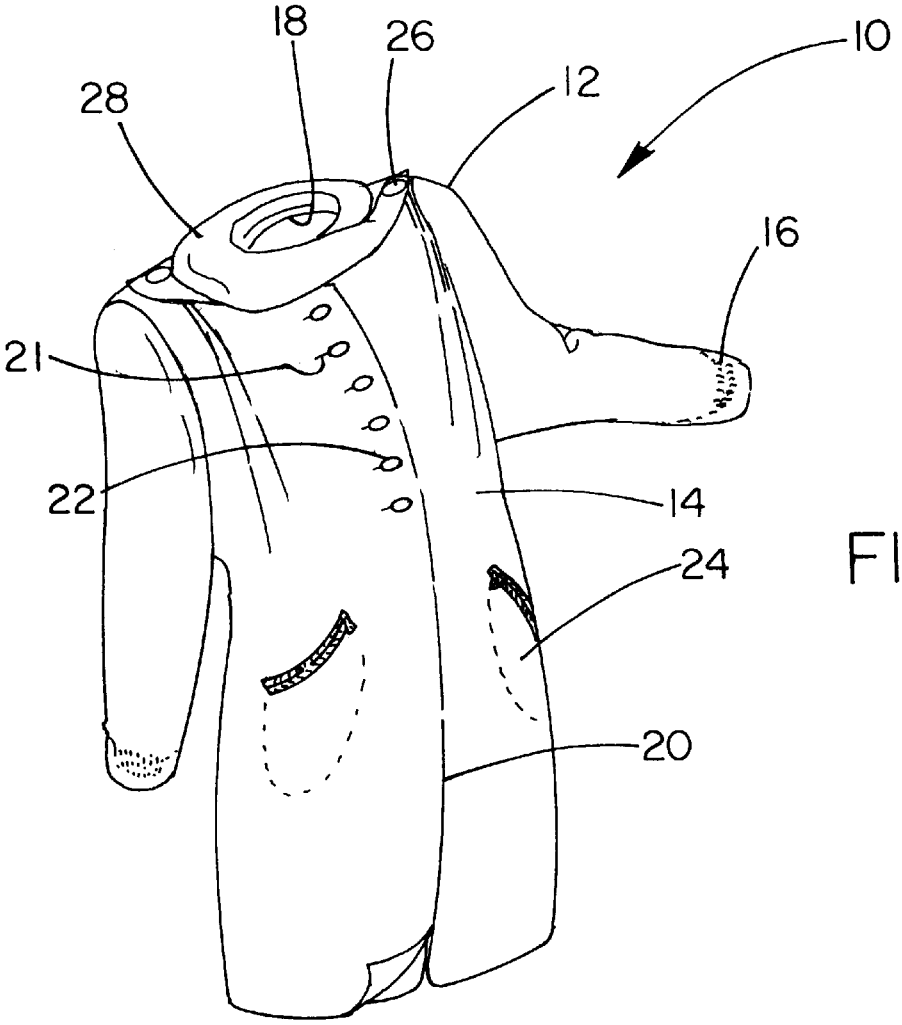
FIG. 1 is a perspective illustration of the preferred embodiment of the coat with attached combined optional hood, collar, and/or scarf constructed in accordance with the principles of the present invention.
Figure 2:
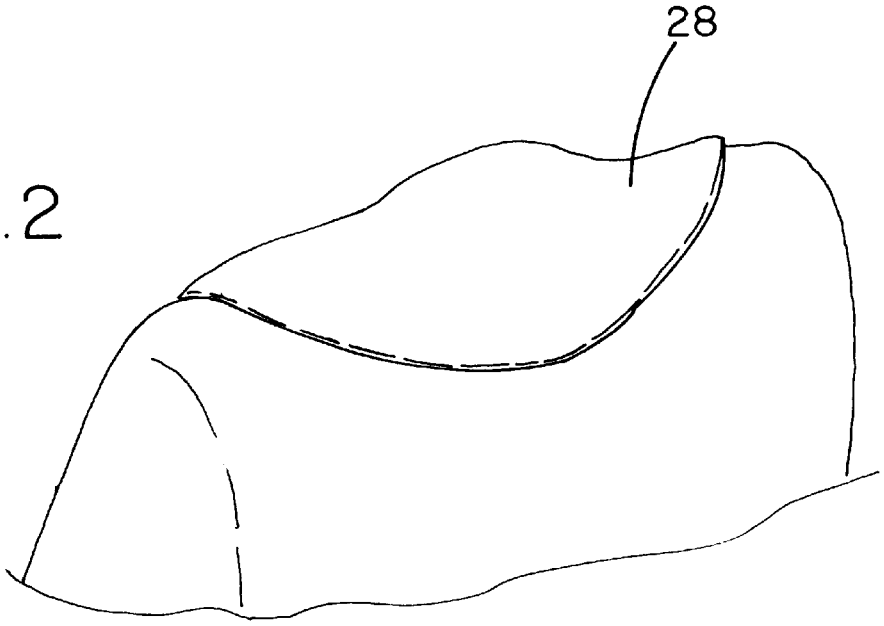
FIG. 2 is a rear view of the present invention.

With reference now to the drawings, and in particular to FIG. 1 thereof, a new and improved coat with attached combined optional hood, collar, and/or scarf embodying the principles and concepts of the present invention and generally designated by the reference numeral 10 will be described.

The present invention, the new and improved coat with attached combined optional hood, collar, and/or scarf, is comprised of a plurality of components. Such components in their broadest context include a coat, buttons and an auxiliary button. Such components are individually configured and correlated with respect to each other so as to attain the desired objective.

Figure 5:
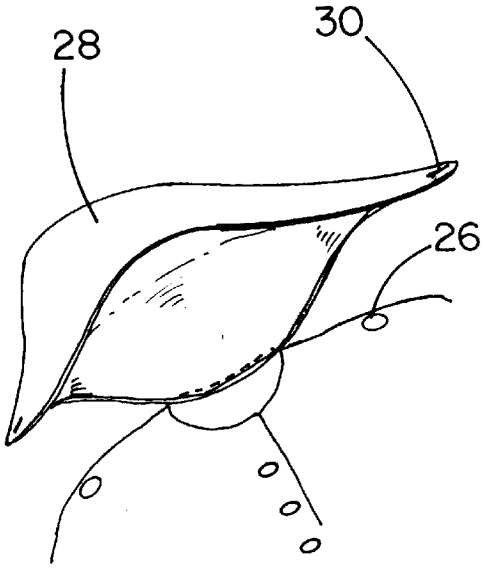
FIG. 5 is a front view of the present invention.
Figure 6:
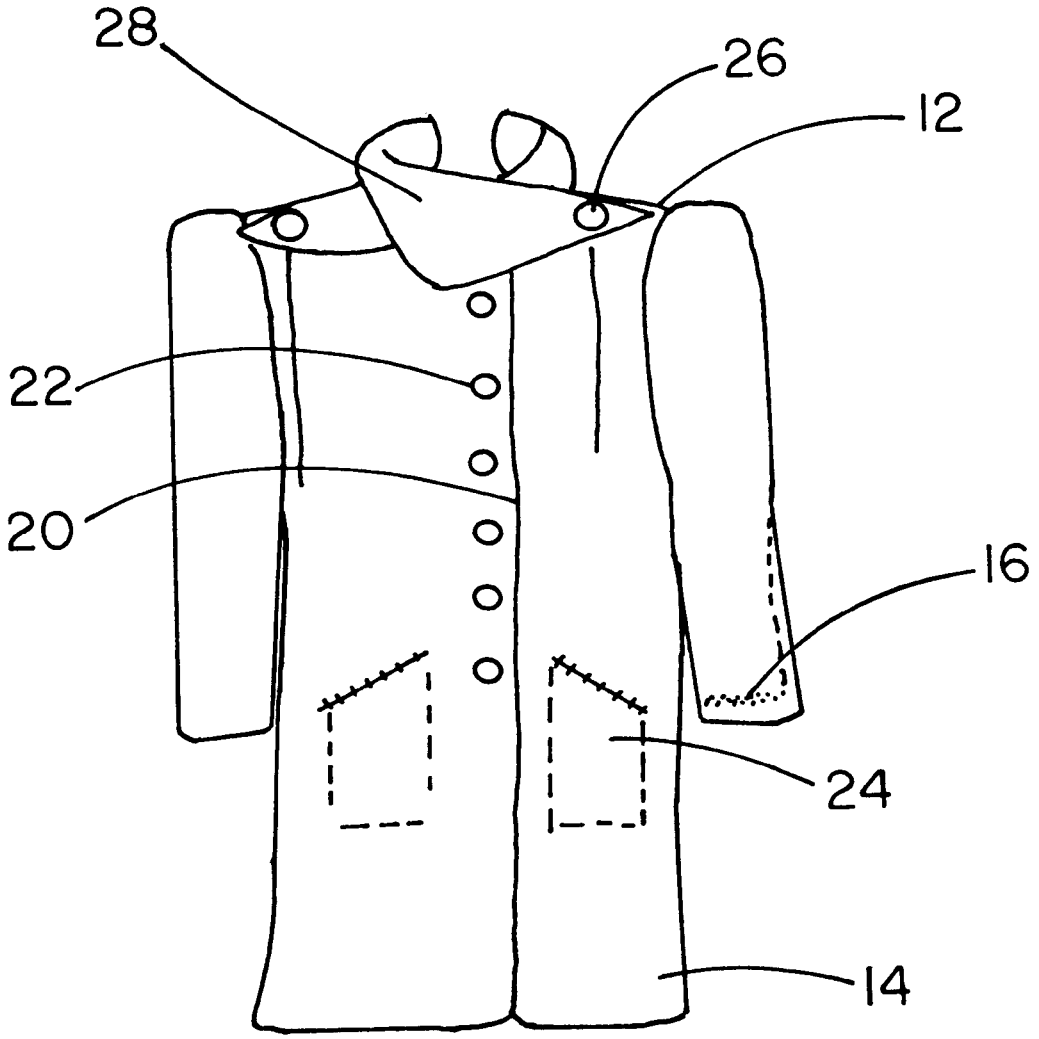
FIG. 6 is a front view of the entire coat of the present invention.

More specifically, it will be noted that the system 10 of the present invention includes a coat 12 having a generally tubular central extent 14 with a pair of arm holes to which upper ends of a pair of long sleeves are appended. In an alternate embodiment, a simple blouse or shirt may be used in lieu of the coat. Lower ends of the sleeves each have an annular elastic band 16 mounted in an interior surface thereof. Note FIG. 6. The central extent further has a circular neck aperture 18 formed on its top. As an option, a short collar may be formed about the neck apertures, as shown in FIG. 5.

A vertical linear slit 20 is formed down a front of the coat thus defining a pair of free edges. Such free edges include a first free edge with a plurality of linearly aligned primary slits 21 formed therein. Associated therewith is a second free edge with a plurality of primary buttons 22 mounted therein for releasably coupling with the primary slits. The primary buttons and slits preferably reside along an upper extent of the vertical slit. A pair of pockets 24 are formed on the front of the central extent on opposite sides thereof. Each pocket defines an open top sealable with a zipper.

Also included is a pair of secondary buttons 26 mounted on a top of the central extent. The secondary buttons are each positioned on diametrically opposed sides of the neck aperture on shoulders of the coat. Preferably, the secondary buttons reside adjacent to eh arm holes of the coat.

Finally, an auxiliary garment 28 includes a pair of cloth pieces each defined by a periphery having a front linear edge and a rear arcuate edge. As shown in FIG. 5, the cloth pieces are each stitched together along the entire rear arcuate edges to define an interior space and an open front. A bottom one of the cloth pieces is stitchedly coupled at a center of the linear edge thereof to a rear peripheral edge of the neck aperture. The cloth pieces of the garment further define a pair of lateral ends each having a secondary slit 30 formed therein. When extended, the lateral ends preferably extend to the arm holes.

Figure 3:
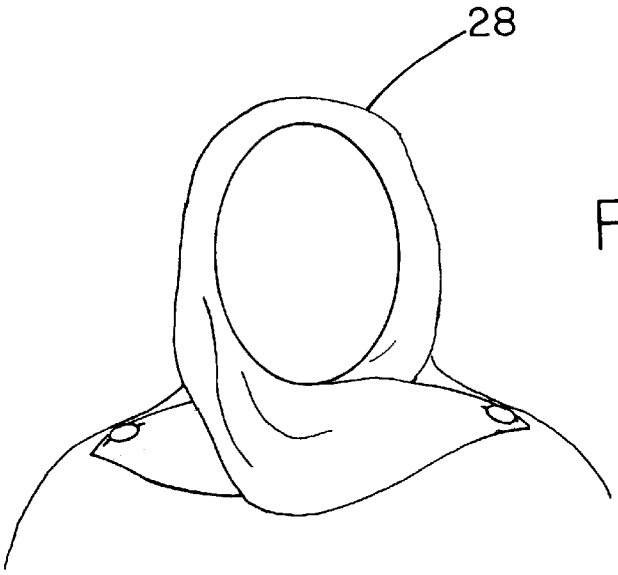
FIG. 3 is a front view of the present invention utilized as a hood.
Figure 4:
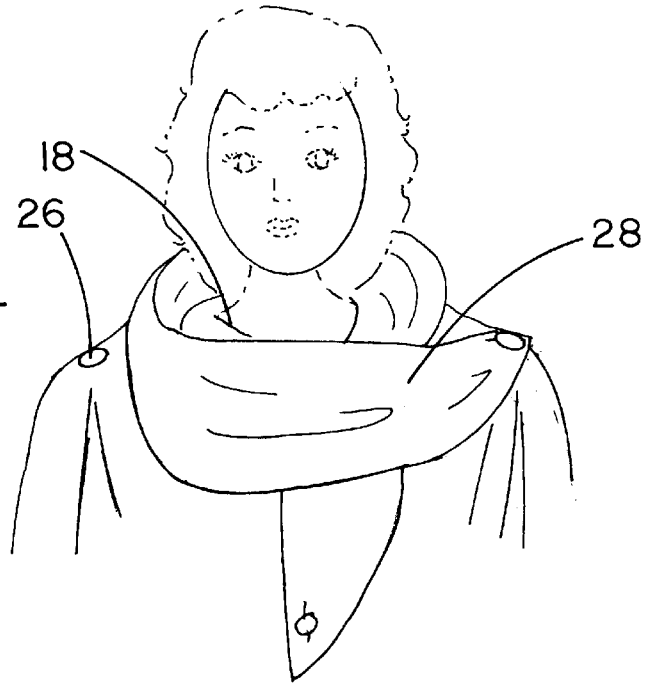
FIG. 4 is a front view of the present invention used as a scarf.

By this structure, the auxiliary garment has a first mode with the secondary slits coupled with the secondary buttons of opposite sides of the coat. As such, the ends cross the front of the coat. Further, the arcuate edges of the auxiliary garment rest on a rear of the coat to define a scarf. Note FIG. 4. In a second mode, the secondary slits are coupled to the secondary buttons on the associated side of the coat. Similar to the previous mode, the arcuate edges of the auxiliary garment are rested on a rear of the coat. In the present mode, however, the auxiliary garment defines a collar. It should be noted that the principles of the first and second mode may be incorporated for alternate designs. Finally, a third mode is possible with the secondary slits coupled with the secondary buttons of opposite sides of the coat. Further, a head of a user resides within an interior space of the auxiliary garment to define a hood. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A coat with attached combined optional hood, collar, and/or scarf comprising, in combination:

a coat having a generally tubular central extent with a pair of arm holes to which upper ends of a pair of long sleeves are appended, wherein the lower ends of the sleeves each have an annular elastic band mounted in an interior surface thereof, the central extent having a circular neck aperture formed on a top thereof, a vertical linear slit formed down a front thereof thus defining a pair of free edges including a first free edge with a plurality of linearly aligned primary slits formed therein and a second free edge with a plurality of primary buttons mounted therein for releasably coupling with the primary slits, and a pair of pockets formed on the front of the central extent on opposite sides thereof, each pocket defining an open top sealable with a zipper;

a pair of secondary buttons mounted on a top of the central extent on diametrically opposed sides of the neck aperture on shoulders of the coat; and an auxiliary garment including a pair of cloth pieces each defined by a periphery having a front linear edge and a rear arcuate edge, the cloth pieces each stitched together along the entire rear arcuate edges to define an interior space and an open front, a bottom one of the cloth pieces stitchedly coupled at a center of the linear edge thereof to a rear peripheral edge of the neck aperture, the cloth pieces of the garment defining a pair of lateral ends having a secondary slit formed therein;

whereby the auxiliary garment has a first mode with the secondary slits thereof coupled with the secondary buttons of opposite sides of the coat such that the ends cross the front of the coat and the arcuate edges of the auxiliary garment rested on a rear of the coat to define a scarf, a second mode with the secondary slits coupled to the secondary buttons on the associated side of the coat and the arcuate edges of the auxiliary garment rested on a rear of the coat to define a collar, a third mode with the secondary slits thereof coupled with the secondary buttons of opposite sides of the coat such that the ends cross the front of the coat and a head of a user resides within an interior space of the auxiliary garment to define a hood.

2. An upper garment comprising:

an upper garment having a neck aperture;

a pair of buttons mounted on a top of the upper garment on diametrically opposed sides of the neck aperture; and an auxiliary garment stitchedly coupled to a rear peripheral edge of the neck aperture and defining a pair of lateral ends having a pair of button holes formed therein for releasably coupled with the buttons.

3. An upper garment as set forth in claim 2 wherein the auxiliary garment defines an interior space and an open front.

4. An upper garment having a neck aperture, a pair of first coupling means mounted on a top of the upper garment on diametrically opposed sides of the neck aperture, and an auxiliary garment stitchedly coupled to a rear peripheral edge of the neck aperture and defining a pair of lateral ends having a second coupling means formed therein for releasably coupling with the first coupling means, the auxiliary garment including a pair of cloth pieces each having a front linear edge and a rear arcuate edge, the cloth pieces stitched together along the entire rear arcuate edges to define an interior space and an open front.

5. An upper garment as set forth in claim 2 wherein the auxiliary garment is capable of defining a hood.

6. An upper garment as set forth in claim 2 wherein the auxiliary garment is capable of defining a scarf.

7. An upper garment as set forth in claim 2 wherein the auxiliary garment is capable of defining a collar.

8. An upper garment as set forth in claim 2 wherein the second coupling means is further adapted to be releasably coupled to first coupling means mounted on a front of the upper garment.

9. An upper garment as set forth in claim 2 wherein the upper garment includes at least one additional button adapted for selective coupling with one of the button holes.

* * * * *

UNITED STATES PATENT AND TRADEMARK OFFICE

CERTIFICATE OF CORRECTION

PATENT NO. : 5,920,906
DATED : July 13, 1999
INVENTOR(S) : Barbara Good

It is certified that error appears in the above-identified patent and that said Letters Patent is hereby corrected as shown below:

On the title page, item [76], should read:

Barbara Good, 3 Riverside Drive, Apt. 6J,
Saranac Lake, NY 12983

Signed and Sealed this

Twenty-first Day of November, 2000

*Attest:*

Q. TODD DICKINSON

*Attesting Officer*

*Director of Patents and Trademarks*